US005873015A

United States Patent [19]

Christy

[11] Patent Number: 5,873,015

[45] Date of Patent: Feb. 16, 1999

[54] LIKE POLARITY BIASING TO CONTROL TONER DUSTING

[75] Inventor: Orrin D. Christy, North Tonawanda, N.Y.

[73] Assignee: Moore U.S.A. Inc., Grand Island, N.Y.

[21] Appl. No.: 802,843

[22] Filed: Feb. 18, 1997

[51] Int. Cl.[6] ..... G03G 15/16

[52] U.S. Cl. ..... 399/296; 399/314

[58] Field of Search ..... 399/296, 311, 399/313, 314, 316

[56] References Cited

U.S. PATENT DOCUMENTS

| | | | |
|---|---|---|---|
| 3,830,589 | 8/1974 | Allen | 399/314 |
| 3,832,053 | 8/1974 | Goel et al. | 399/312 |
| 3,992,557 | 11/1976 | Kubo et al. . | |
| 4,098,227 | 7/1978 | Thompson | 399/310 |
| 4,260,235 | 4/1981 | Stack . | |
| 4,401,380 | 8/1983 | Suzuki et al. | 399/145 |
| 4,736,227 | 4/1988 | Till et al. | 399/296 |
| 4,823,158 | 4/1989 | Casey et al. | 399/316 |
| 4,849,784 | 7/1989 | Blanchet-Fincher et al. | 399/316 |
| 5,010,370 | 4/1991 | Araya et al. . | |
| 5,198,864 | 3/1993 | Fletcher . | |
| 5,282,006 | 1/1994 | Fletcher . | |
| 5,303,014 | 4/1994 | Yu et al. . | |
| 5,406,359 | 4/1995 | Fletcher . | |
| 5,438,399 | 8/1995 | Asai . | |
| 5,450,180 | 9/1995 | Ohzeki et al. . | |
| 5,452,063 | 9/1995 | Fletcher . | |
| 5,465,135 | 11/1995 | Nakagama et al. . | |
| 5,499,085 | 3/1996 | Christy et al. . | |
| 5,504,564 | 4/1996 | Snelling . | |

FOREIGN PATENT DOCUMENTS

| | | |
|---|---|---|
| 55-029851 | 3/1980 | Japan . |
| 60-057860 | 4/1985 | Japan . |
| 02226282 | 9/1990 | Japan . |
| 03267971 | 11/1991 | Japan . |
| 04208970 | 7/1992 | Japan . |
| 05313507 | 11/1993 | Japan . |

*Primary Examiner*—Robert Beatty
*Attorney, Agent, or Firm*—Nixon & Vanderhye, P.C.

[57] ABSTRACT

Charged toner is transferred from an image member to a web of imagable material, such as paper, using an impression cylinder without toner back scatter even at high speed (e.g. more than 150 feet per minute) movement of the paper. A nip is provided between the image member and the impression cylinder. Toner having a first polarity is applied to the image member, and a second face of a paper web is moved into contact with the image member adjacent the nip so that toner transfers from the image member to the web face. An electric potential of a first polarity is applied to the web at the first face prior to and adjacent the nip, the potential of sufficient intensity so as to substantially prevent back scatter. The electrical potential may be applied using an electrical conductive electrode biased (e.g. with a spring) into contact with the first face of the paper web, and connected up to a power supply of a first polarity. Alternatively, the electrical potential may be applied using a corona generating device connected to a power supply of the first polarity and shielded from the impression cylinder.

17 Claims, 4 Drawing Sheets

25
110
11
18
22
19
37
20
39
35
34
23
44
43
33
38
41
40
22
12
21
16
17
32
31
14
15
13
24

LIKE POLARITY BIASING TO CONTROL TONER DUSTING

BACKGROUND AND SUMMARY OF THE INVENTION

The problem of back scatter as a result of aerodynamic forces acting at a nip between members of a non-impact, electrostatic printing system, is recognized in U.S. Pat. No. 5,499,085 (the disclosure of which is hereby incorporated by reference herein). The system and method of the U.S. Pat. No. 5,499,085 patent are extremely effective in controlling trailing edge dusting on the MIDAX 300 electrostatic printer, as well as other printers. However, there are some other types of electrostatic printers which have configurations that make the particular mechanism of the U.S. Pat. No. 5,499,085 patent for preventing back scatter—namely, applying an electrical bias of the same polarity as toner to the impression cylinder—not as practical. For example, in the Nipson-Printing Systems Varypress, and other types of non-impact electrostatic printing systems having semi-conductive elastomeric rollers, or similar components, or having component geometries which differ significantly from the preferred embodiments of the U.S. Pat. No. 5,499,085 patent, some other mechanism is desirably used in order to prevent back scatter.

According to the present invention an electrostatic printing system, and method of transferring charged poundered toner from an imaged member to a web of imagable material (such as paper), are provided which solve the problem of edge dusting (toner back scatter) in a wide variety of printer component embodiments, including the Nipson-Printing Systems Varypress. According to the present invention it is possible to operate the Nipson-Printing Systems Varypress at high speeds (i.e. over 150 feet per minute, e.g. about 200–300 feet per minute) while achieving excellent print quality, and in a manner—for the particular configurations involved—with greater effectiveness than the mechanism used in the U.S. Pat. No. 5,499,085 patent. According to the present invention the two main mechanisms that may be utilized include a particularly configured electrode biased against the web face which engages the impression cylinder at the nip area, and a shielded corona generator at that area.

According to one aspect of the present invention a non-impact electrostatic printing system is provided comprising the following components: An image member to which poundered toner having a first polarity is applied. A semi-conductive elastomeric roller having an outer periphery, the outer periphery positioned to form a nip with the image member, the roller biased to a second polarity opposite the first polarity. The elastomeric roller rotatable about a first axis (e.g. by a conventional motor of any type). A web of imagable material which passes through the nip to have toner from the image member transferred thereto, the web having a first face which moves into engagement with the elastomeric roller, and a second face which engages the image member at the nip. An idler roller rotatable about a second axis substantially parallel to the first axis, and having an outer periphery spaced from the elastomeric roller outer periphery and for engaging the web first face and for guiding the web to the nip. And means for applying an electrical potential of the first polarity to the web at the first face thereof between the idler and elastomeric rollers, of sufficient intensity so as to substantially prevent back scatter of toner as a result of aerodynamic forces acting between the web and the image member.

In one embodiment the electrical potential applying means may comprise a conductive electrode mechanically biased into contact with the web (e.g. paper) first face, and connected to a power supply having the first polarity (e.g. positive). The conductive electrode may have a tapered first end extending at least partially into the nip so as to maintain the first polarity through the web onto the toner until the web and the image member are in intimate contact. The conductive electrode may be spring loaded, and the spring load actually biases the web into contact with the image member prior to the web actually engaging the elastomeric roller (impression cylinder). The conductive electrode is at all times spaced from the elastomeric roller and the idler roller, however. The poundered toner may have the first polarity imparted thereto, or reinforced therein, by a precharging station disposed prior to the conductive electrode and the nip in the direction of the image member movement. The image member may comprise a belt or other conventional structure, but preferably comprises an image cylinder rotatable about a third axis substantially parallel to the first and second axes.

In another embodiment, the electrical potential applying means comprises a corona generating device connected to a power supply of the first polarity and shielded from the rollers. For example, the corona generating device may comprise a single corona wire (or multiple wires), and the wire may be shielded from the rollers by a substantially arcuate shield. For example, the corona wire and shield may be positioned with respect to the nip so that the web is in substantially intimate contact with the image member before the web is shielded from ions emanating from the corona wire, and the elastomeric roller outer periphery may actually engage the web after the web is in substantial intimate contact with the image member.

Other mechanisms (such as belts, rollers, or other mechanical or electrical or electromechanical components) may be used as the means for applying the electrical potential as long as positioned in operative association with the web at the first face of the web adjacent the nip.

According to another aspect of the present invention a non-impact electrostatic printing system is provided comprising the following components: An image cylinder to which toner having a first polarity is applied and rotatable about a first axis. An impression cylinder having an outer periphery, the outer periphery positioned to form a nip with the image member. The impression cylinder rotatable about a second axis substantially parallel to the first axis. A web of imagable material which passes through the nip to have toner from the image cylinder transferred thereto, the web having a first face which moves into engagement with the impression cylinder, and a second face which engages the image cylinder at the nip. And means for applying an electrical potential of the first polarity to the web at the first face thereof adjacent the nip.

In one preferred embodiment the electrical potential applying means comprises a conductive electrode mechanically biased into contact with the web first face and connected to a power supply having the first polarity, the conductive electrode have a tapered first end extending at least partially into the nip so as to maintain the first polarity through the web onto the toner until the web and the image cylinder are in intimate contact. In another embodiment the electrical potential applying means comprises a corona wire (one or more) connected to a power supply of the first polarity and shielded from the impression cylinder by a substantially arcuate shield.

According to another aspect of the present invention a method of transferring charged toner from an image web to a web of imagable material, such as paper, having first and second faces, using an impression cylinder, and a nip provided between the image member and the compression cylinder, is provided. The method comprises the steps of: a) Providing poundered toner having a positive first polarity on the image member. b) Moving the second face of the web of imagable material into contact with the image member adjacent the nip, at a speed greater than 150 feet per minute, so that toner transfers from the image member to the web second face. And c) applying an electrical potential of the positive first polarity to the web at the first face thereof prior to and adjacent the nip, the potential of sufficient intensity so as to substantially prevent back scatter of poundered toner as a result of aerodynamic forces acting between the web and the image member.

Step c) may be practiced by mechanically biasing an electrically conductive electrode, connected up to a power supply of the first polarity, into contact with the web first face. Step c) may be further practiced so as to maintain said first polarity through the web onto the toner until the web and the image member are in intimate contact, spring loading actually biasing the web into contact with the image member prior to the web actually engaging the impression cylinder.

Alternatively, step c) may be practiced by applying electrical potential using a corona generating device connected to a power supply of the first polarity and shielded from the impression cylinder. Step c) may be further practiced by using as the corona generating device a corona wire shielded from the impression cylinder by a substantially arcuate shield.

It is the primary object of the present invention to effectively prevent back scatter of toner in particular types of electrostatic printing systems. This and other objects of the invention will become clear from an inspection of the detailed description of the invention, and from the appended claims.

DETAILED DESCRIPTION OF THE DRAWINGS

Figure 1:
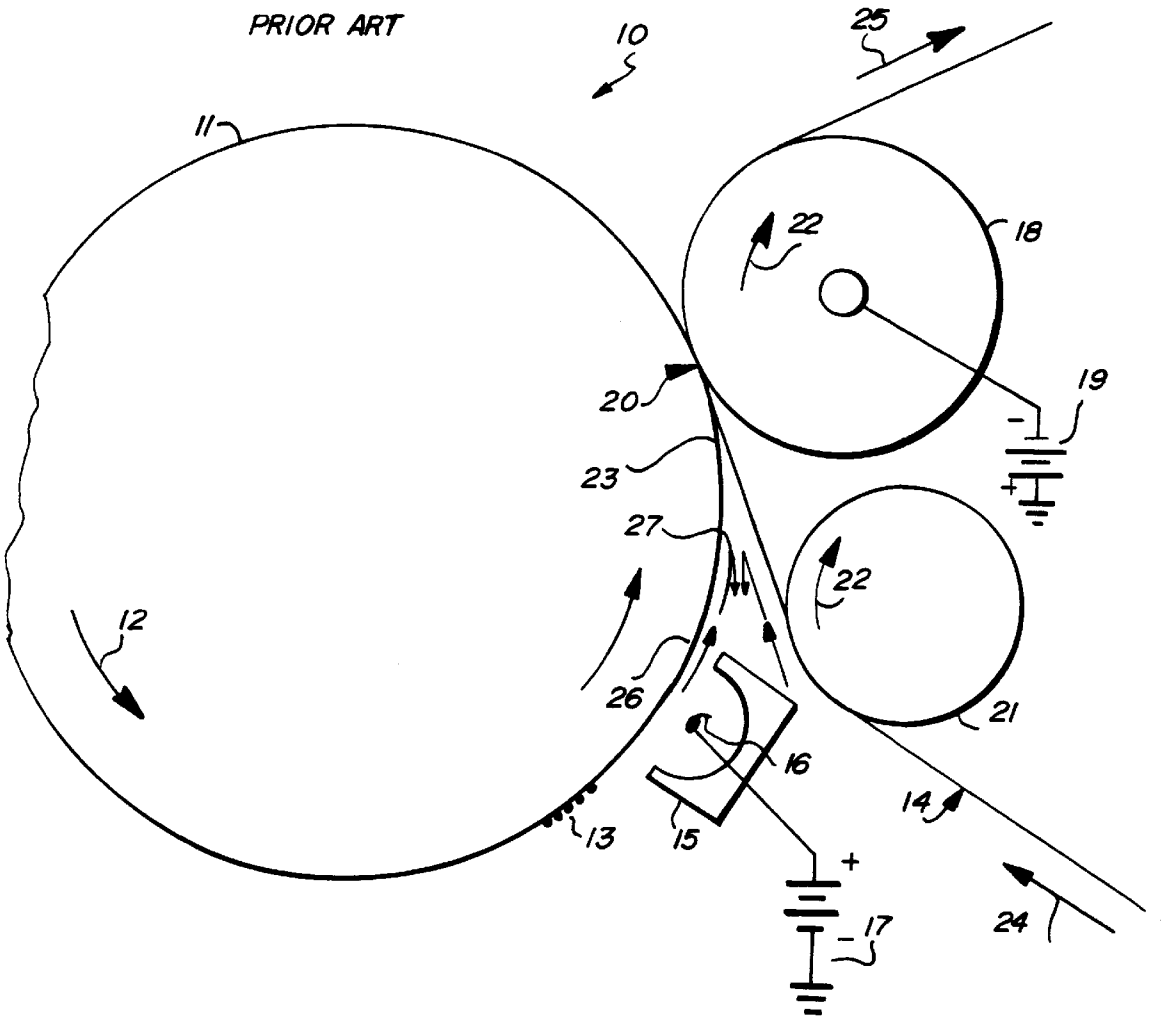
Fig. 1 PRIOR ART
FIG. 1 is a side schematic view showing the operative components of an electrostatic non-impact printing device according to the prior art at which back scatter may take place.

FIG. 1 is a schematic illustration of a configuration of the transfer station of a conventional Nipson-Printing Systems Varypress electrostatic print engine, or a similar type of print engine. The electrostatic printing system 10 of FIG. 1 includes an image member 11—which may be a belt or other conventional image member, but preferably is an imaging cylinder or drum as illustrated—which rotates in counter-clockwise direction 12. Toner having a first polarity (e.g. positive) is illustrated schematically at 13 in FIG. 1 and is attracted to an electrostatic latent image or magnetic latent image on the image cylinder 11. The image is created by conventional image producing means (not shown). The toner 13 may or may not be charged to the first polarity at the position shown in FIG. 1, but before entry into an area where it will be transferred to a moving web of imagable material (e.g. paper) 14 it is charged. For example, the charging may be accomplished by the pre-charging station 15 which, in the exemplary embodiment illustrated, comprises a corona wire 16 surrounded by a grounded shield 15 and biased to a high voltage potential (e.g. positive) by a power supply 17, e.g. a potential between about and 4000 and 6000 volts. The precharging station 15 bombards the toner 13 on the cylinder 11 periphery with positive ions, causing the toner 13 to become positively charged (or to reinforce the positive charge therein).

A system 10 also includes an impression cylinder 18, typically in the form of a negatively charged (i.e. opposite polarity of the toner 13) semi-conductive elastomeric roller. The second polarity power supply 19 effects this electrical biasing. A nip 20 is provided between the roller 18 outer periphery and the image cylinder 11 outer periphery. A web 14 guiding idler roller 21 is preferably also provided. The rollers 18, 21 rotate in a clockwise direction 22, that is opposite the direction of rotation 12 of the image cylinder 11, and the rollers/cylinders 18 and 21, are all rotatable about parallel axes (which are typically substantially horizontal). The idler roller 21 is positioned so that the paper web 14 comes into contact with the image cylinder 11 at a contact point 23 somewhere before the nip 20. The positively charged toner 13 is transferred to the paper web 14 at the nip 20 by the electric field force created by the negatively biased elastomeric roller 18.

The rollers/cylinders 11, 18 are typically rotated about their axes by one or more conventional motors, such as electrical motors (not shown), gear trains, or any other conventional powered device for rotating a roller about an axis, and they, and/or in cooperation with other drive components, drive the web 14 in the direction 24 toward the components of the system 10, in the direction 25 away from the components.

Figure 2:
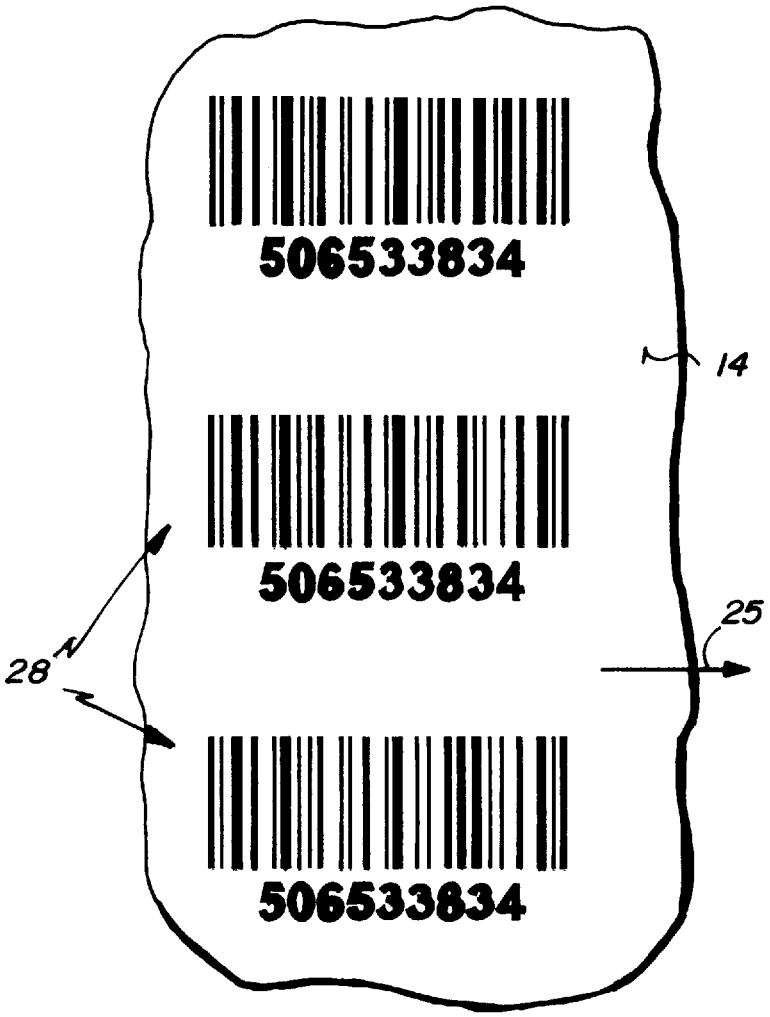
FIG. 2 is a schematic showing of back scatter printing which is undesirably obtained utilizing the apparatus of FIG. 1 when operated at high speeds.

At higher throughput speeds, typically greater than 150 feet per minute, another force on the toner becomes important to maintaining an integral image. Entrained air streams illustrated schematically at 26 in FIG. 1 on the cylinder 11 and paper 14 travel along with the surfaces thereof and begin to build pressure as they approach the paper contact point 23. At some point, which may be known as a reflection point 27, the air pressure reaches its threshold level where it must escape by blowing backwards between the two approaching entrained air streams 26. Here, with the toner 13 only loosely held in place on the image cylinder 11 periphery, the escaping air stream carries bits of toner 13 back away from the nip point 20 and deposits the scattered toner into areas trailing the image. That is, back scatter of toner as a result of aerodynamic forces acting between the web 14 and the image member 11 causes "edge dusting" or poor print quality. FIG. 2 schematically illustrates this poor print quality with ladder style bar codes 28, with reference to the direction of movement 25 of the web 14 on which the bar codes 28 are imaged. Particularly vulnerable to this effect are thin horizontal lines in closed characters such as "U", "O", "C" and others which can form trapping air pockets.

Figure 3:
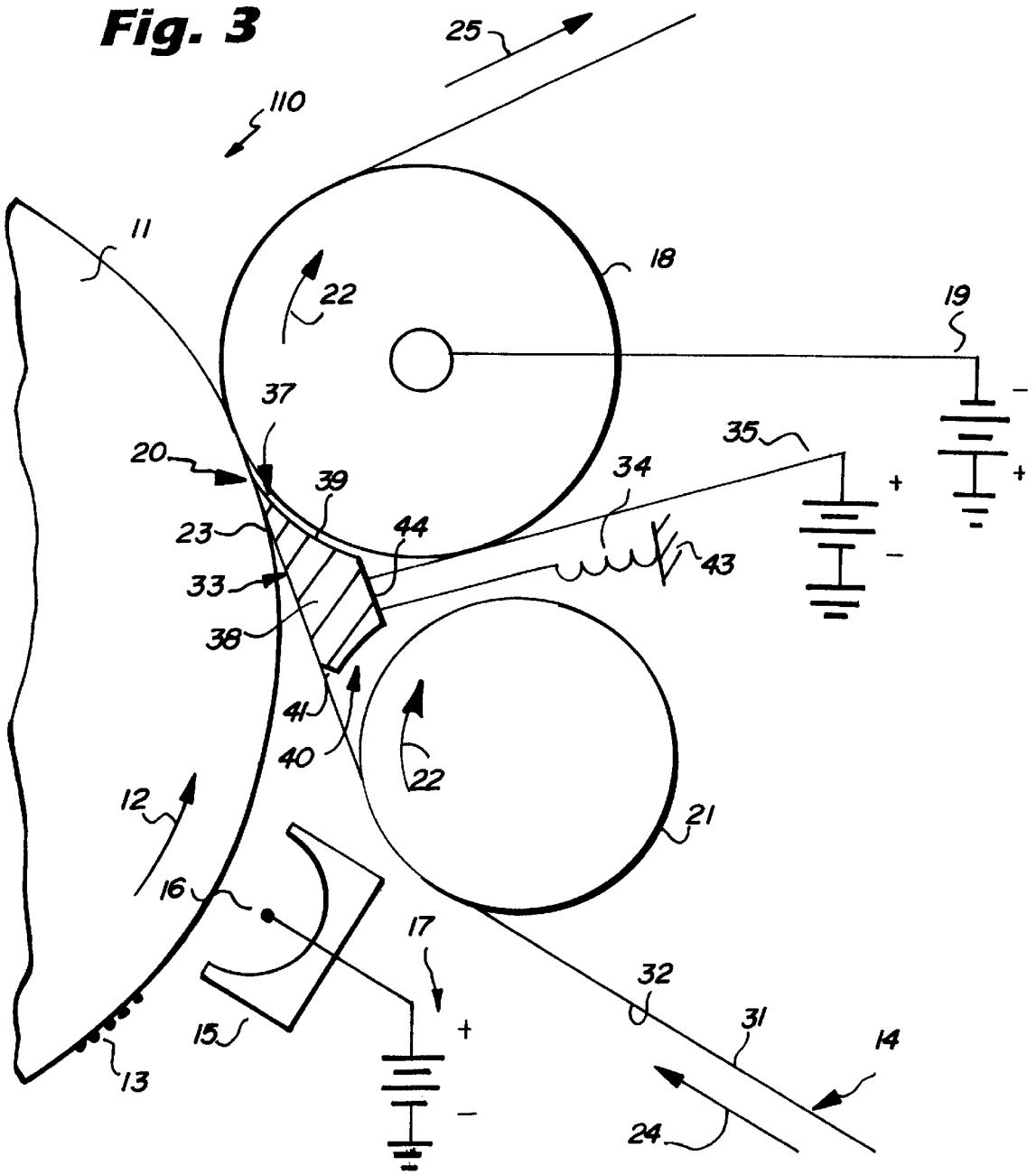
FIGS. 3 and 4 are side schematic views of two different embodiments of apparatus according to the present invention which substantially prevent back scatter at high speed operation.
Figure 4:
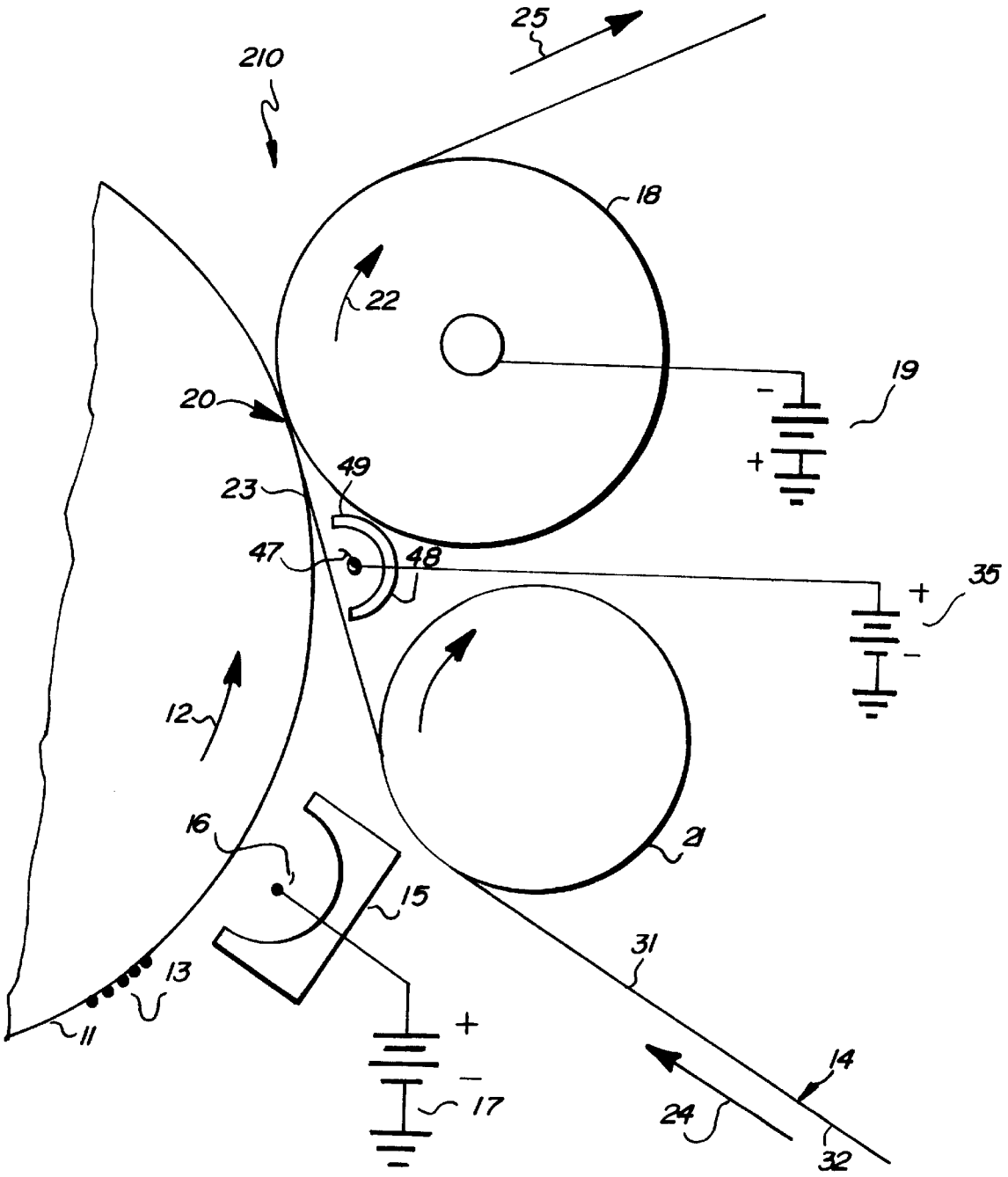

The problem of back scatter is solved according to the present invention, two exemplary embodiments of which are illustrated schematically in FIGS. 3 and 4. That is, by practicing the invention as schematically illustrated in FIGS. 3 and 4, back scatter of toner as a result of aerodynamic forces acting between the web and image member is substantially prevented (i.e. that is completely prevented, or at least vastly improved for the magnification level illustrated in FIG. 2). In both FIGS. 3 and 4 components identical to those of the system 10 of FIG. 1 are shown by the same reference numeral.

The web (e.g. of paper) 14 has a first face 31 which moves into contact with the idler roller 21 and the impression cylinder 18 peripheries, and a second face 32 which moves into contact with the image member 11 and onto which the toner 13 is transferred in the form of an appropriate image (e.g. printed words, bar codes, picture, drawings, etc.). In the embodiment of FIG. 3 back scatter is substantially prevented by means for applying an electrical potential of the first polarity (positive in the system illustrated in FIG. 3) to the first face 31 between the rollers 18, 21, e.g. immediately adjacent the nip 20. The electrical potential applied is of sufficient intensity so as to substantially prevent back scatter. This means, in the embodiment of FIG. 3, comprises an electrically conductive electrode 33 mechanically biased, e.g. by a spring 34, into contact with the web 14 first face 31, and connected to a power supply 35 of the first polarity. The power supply 35 intensity may be adjustable depending upon the speed of movement of the web 14 (e.g. in the direction 25), a higher potential being provided at higher speeds, but typically is in the range between about 100–800 volts, e.g. between about 300–400 volts for a web speed of around 200 feet per minute.

The electrode 33 preferably has a configuration such as illustrated in FIG. 3 wherein it has a tapered first end 37 extending at least partially into the nip 20 area so as to maintain the first polarity through the web 14 onto the toner 13 until the web 14 and image member 11 are in substantially intimate contact (e.g. at the contact area 23). The electrode 33 preferably has a flat or gently curved surface 38 which actually contacts the web face 31, and the surface 38 is sufficiently smooth, or made of sufficiently low friction materials, so that the web 14 easily moves therepast. Part of the tapering of the first end 37 is provided by the surface 39 which preferably has a curvature similar to that of the roller 18. The trailing end 40 of the electrode 33 may have an upwardly (away from the web 14) curved termination 41. At all times the electrode 33 is spaced from the rollers 18, 21.

While a mechanical biasing of the electrode 33 into contact with the face 31 may be provided by a wide variety of components such as pneumatic cylinders, linkages, primarily or exclusively weight (if the orientation of the components is correct with respect to the force of gravity), or the like, preferably the biasing is accomplished utilizing a spring 34, such as a coil compression spring, a block of compressible material, or the like, acting between a stationary surface 43 and the face 44 of the electrode 33 opposite the face 38 which engages the web 14. The biasing means 34 may engage the electrode 33 in any manner that precludes the electrode 33 moving into contact with the roller 18, or significantly interfering in the movement of the web 14 even when the web 14 is moving in the direction 25 at high speed (i.e. greater than 150 feet per minute, e.g. 200–300 feet per minute, or even more).

The system of the embodiment FIG. 4, indicated generally by reference numeral 210, is the same as that of FIG. 3 (and like components have like reference numerals) except for the means of applying an electrical potential of the first polarity to the web 14 at the first face 31 thereof adjacent the nip 20. In the embodiment of FIG. 4 the electrical potential applying means comprises a corona generating device connected to the power supply 35 of the first polarity and shielded from the rollers 18, 21. For example, a single corona wire 47 (or multiple corona wires, or other configurations of corona generating components) is provided, disposed adjacent the face 31 of web 14 between the cylinders 18, 21, and preferably just before the contact point 23 in the direction of movement 25 of the web 14. The corona wire 47 is disposed within a substantially arcuate shield 48 of conventional construction (similar to the shield 15 only thinner so as to properly fit in the space between the rollers 18, 21 and not touch either of them). The end 49 of the shield 48 closest to the roller 18 is located—as schematically illustrated in FIG. 4—so that the web 14 face 32 is in substantially intimate contact with the image member 11 before the web 14 is shielded from ions emanating from the corona wire 47, and the roller 18 outer periphery actually engages the web 14 face 31 after the web 14 is in substantially intimate contact with the image member 11 (at point 23). That is, the end 49 is positioned substantially at the contact point 23.

Other means for applying electrical potential of the first polarity to the web 14 adjacent the nip 20 may also be provided as long as they are practical for the particular geometry of the printing system involved. For example, under some circumstances belts, rollers, or the like may be provided as the electrode, or instead of the electrode or corona generator, for applying sufficient potential.

Utilizing the systems of FIGS. 3 and 4, a method of transferring charged toner 13 from the image member 11 to the paper web 14 using the impression cylinder 18, with a nip 20 provided between the image member 11 and the impression cylinder 18, is provided. The method comprises the steps of: (a) Providing toner 13 having a first polarity (e.g. positive) on the image member 11 (by applying the toner 13 already charged, or charging it, or enhancing its charge, utilizing the precharging station 15). (b) Moving the second face 32 of the paper web 14 into contact with the image member 11 adjacent the nip 20 (e.g. at the contact area 23) so that the toner 13 transfers from the image member to the web second face 32 (between and at the contact area 23 in the nip 20) at a speed greater than 150 feet per minute (e.g. at least about 200–300 feet per minute) so that toner transfers from the image member 11 to the web second face 32. And (c) applying an electrical potential of the first polarity to the web 14 at the first face 31 thereof prior to and adjacent the nip 20, the potential of sufficient intensity (e.g. about 100–800 volts, which may be dependent upon speed) so as to substantially prevent back scatter of toner as a result of aerodynamic forces (see arrows 27 in FIG. 1) acting between the web 14 and the image member 11. Step (c) may be practiced by mechanically biasing an electrically conductive electrode 33 (see FIG. 3) connected up to a power supply 35 of the first polarity into contact with the web first face 31, for example spring 34 loading actually biasing the web 14 into contact with the image member 11 (at area 23) prior to the web actually engaging the impression cylinder 18. Alternatively, step (c) may be practiced (as seen in FIG. 4) by applying the electrical potential utilizing the corona generating device such as the corona wire 47, shielded from the impression cylinder 18 by shield 48 so that the web is in substantially intimate contact with the image member 11 (at area 23) before the web 14 is shielded from ions emanating from wire 47.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A non-impact electrostatic printing system comprising:

an image member to which poundered toner having a first polarity is applied;

a semi-conductive elastomeric roller having an outer periphery, said outer periphery positioned to form a nip with said image member, and said roller biased to a second polarity opposite said first polarity;

said elastomeric roller rotatable about a first axis;

a web of imagable material which passes through said nip to have toner from said image member transferred thereto, said web having a first face which moves into engagement with said elastomeric roller, and a second face which engages said image member at said nip;

an idler roller rotatable about a second axis substantially parallel to said first axis, and having an outer periphery spaced from said elastomeric roller outer periphery and for engaging said web first face and for guiding said web to said nip; and means for applying an electrical potential of said first polarity to said web at said first face thereof between said idler and elastomeric rollers, of sufficient intensity so as to substantially prevent back scatter of poundered toner as a result of aerodynamic forces acting between said web and said image member.

2. A system as recited in claim 1 wherein said electrical potential applying means comprises an electrically conductive electrode mechanically biased into contact with said web first face and connected to a power supply having said first polarity.

3. A system as recited in claim 2 wherein said conductive electrode has a tapered first end extending at least partially into the area of said nip so as to maintain said first polarity through said web onto said toner until said web and said image member are in substantially intimate contact.

4. A system as recited in claim 3 wherein said conductive electrode is spring loaded and said spring loading biases said web into contact with said image member prior to said web actually engaging said elastomeric roller.

5. A system as recited in claim 4 wherein said conductive electrode is at all times spaced from said elastomeric roller and said idler roller.

6. A system as recited in claim 2 wherein said toner has said first polarity imparted thereto or reinforced therein by a precharging station disposed prior to said conductive electrode and said nip in the direction of image member movement.

7. A system as recited in claim 6 wherein said image member comprises an image cylinder rotatable about a third axis substantially parallel to said first and second axes.

8. A system as recited in claim 2 wherein said web of imagable material comprises a paper web.

9. A system as recited in claim 8 wherein said conductive electrode is mechanically biased by a spring.

10. A system as recited in claim 1 wherein said electrical potential applying means comprises a corona generating device connected to a power supply of said first polarity and shielded from said rollers.

11. A system as recited in claim 10 wherein said corona generating device comprises a corona wire, and wherein said wire is shielded from said rollers by a substantially arcuate shield.

12. A system as recited in claim 11 wherein said shield and said corona wire are positioned with respect to said nip so that said web is in substantially intimate contact with said image member before said web is shielded from ions emanating from said corona wire, and wherein said elastomeric roller outer periphery actually engages said web after said web is in substantially intimate contact with said image member.

13. A non-impact electrostatic printing system comprising:

an image cylinder to which powdered toner having a first polarity is applied and rotatable about a first axis;

an impression cylinder having an outer periphery, said outer periphery positioned to form a nip with said image cylinder;

said impression cylinder rotatable about a second axis substantially parallel said first axis;

a web of imagable material which passes through said nip to have toner from said image cylinder transferred thereto, said web having a first face which moves into engagement with said impression cylinder, and a second face which engages said image cylinder at said nip;

means for applying an electrical potential of said first polarity to said web at said first face thereof adjacent said nip; and wherein said electrical potential applying means comprises a conductive electrode mechanically biased into contact with said web first face and connected to a power supply having said first polarity, said conductive electrode have a tapered first end extending at least partially into the area of said nip so as to maintain said first polarity through said web onto said toner until said web and said image cylinder are in substantially intimate contact.

14. A method of transferring charged toner from an image member to a web of imagable material having first and second faces, using an impression cylinder, a nip provided between the image member and impression cylinder, comprising the steps of:

a) providing powdered toner having a first polarity on the image member;

b) moving the second face of the web of imagable material into contact with the image member adjacent the nip, at a speed greater than 150 feet per minute, so that toner transfers from the image member to the web second face;

c) applying an electrical potential of said first polarity to the web at the first face thereof prior to and adjacent the nip, the potential of sufficient intensity so as to substantially prevent back scatter of powdered toner as a result of aerodynamic forces acting between the web and the image member; and wherein step c) is practiced by mechanically biasing an electrically conductive electrode, connected to a power supply of the first polarity, into contact with the web first face.

15. A method as recited in claim 14 wherein step c) is further practiced so as to maintain said first polarity through the web onto the toner until the web and the image member are in intimate contact, by spring biasing the web into contact with the image member prior to the web actually engaging the impression cylinder.

16. A method as recited in claim 14 wherein said polarity is a positive charge.

17. A method of transferring charged toner from an image member to a web of imagable material having first and second faces, using an impression cylinder, a nip provided between the image member and impression cylinder, comprising the steps of:

a) providing powdered toner having a first polarity on the image member;

b) moving the second face of the web of imagable material into contact with the image member adjacent the nip, at a speed greater than 150 feet per minute, so that toner transfers from the image member to the web second face; and c) applying an electrical potential of said first polarity to the web at the first face thereof prior to and adjacent the nip, the potential of sufficient intensity so as to substantially prevent back scatter of powdered toner as a result of aerodynamic forces acting between the web and the image member;

wherein step c) is practiced by applying electrical potential using a corona generating device connected to a power supply of said first polarity and shielded from the impression cylinder; and wherein step c) is further practiced by using as the corona generating device a corona wire shielded from the impression cylinder by a substantially arcuate shield, the shield and the corona wire positioned with respect to the nip so that the web is in substantially intimate contact with the image member before the web is shielded from ions emanating from the corona wire.

* * * * *